United States Patent [19]

Karlsson et al.

[11] Patent Number: 5,040,601

[45] Date of Patent: Aug. 20, 1991

[54] HORIZONTAL WELL BORE SYSTEM

[75] Inventors: Haraldur Karlsson, Kingwood; Gary E. Jacques, Houston, both of Tex.; James L. Hatten, Sumrall, Miss.; John K. Aslakson, Sandy, Utah

[73] Assignee: Baker Hughes Incorporated, Houston, Tex.

[21] Appl. No.: 541,839

[22] Filed: Jun. 21, 1990

[51] Int. Cl.[5] ..... E21B 43/04

[52] U.S. Cl. ..... 166/278; 166/387

[58] Field of Search ..... 166/380, 386, 387, 278, 166/51; 175/62, 61, 75, 107, 258, 259

[56] References Cited

U.S. PATENT DOCUMENTS

| | | | |
|---|---|---|---|
| Re. 32,267 | 10/1986 | Cherrington | 175/53 |
| 2,207,334 | 7/1940 | Reynolds et al. | 166/21 |
| 4,003,440 | 1/1977 | Cherrington | 175/61 |
| 4,091,631 | 5/1978 | Cherrington | 175/62 |
| 4,333,539 | 6/1982 | Lyons et al. | 175/61 |
| 4,733,729 | 3/1988 | Copeland | 166/276 |
| 4,739,842 | 4/1988 | Kruger et al. | 175/76 |
| 4,828,050 | 5/1989 | Hashimoto | 175/45 |
| 4,832,122 | 5/1989 | Corey et al. | 166/272 |
| 4,842,081 | 6/1989 | Parant | 175/22 |
| 4,850,430 | 7/1989 | Copeland et al. | 166/276 |
| 4,856,591 | 8/1989 | Donovan et al. | 166/51 |
| 4,901,804 | 2/1990 | Thometz et al. | 175/40 |
| 4,949,793 | 8/1990 | Rubbo et al. | 166/387 |

OTHER PUBLICATIONS

"Radial Wells and Hazardous Waste Sites", W. Dickinson, et al., RCRA Site Remediation, pp. 232–237.

"Lateral Drilling Technology Tested on UCG Project", P. B. Tracy, IADC/SPE Paper No. 17237, pp. 493–502 (1988).

*Primary Examiner*—Terry Lee Melius

*Attorney, Agent, or Firm*—Michael Polacek

[57] ABSTRACT

The present invention relates to a novel horizontal well bore system. More particularly, the invention relates to the setting of a conductor casing, drilling a well bore to a horizontal position, drilling and screening the horizontal/lateral section of the well, filter packing the well screen, and installing any necessary pumping equipment. The resulting lateral well bore and the method disclosed for forming the same are particularly useful in environmental applications.

14 Claims, 7 Drawing Sheets

HORIZONTAL WELL BORE SYSTEM

BACKGROUND OF THE INVENTION

The present invention pertains to a novel horizontal well bore system which can be used to drill and develop ground water monitoring and remediation wells, and to place horizontal drains for capturing contaminant particles beneath difficult areas such as landfills, lagoons, and storage tanks.

A large variety of horizontal well bore systems have been developed and used in the past. Generally, these systems begin with a vertical hole or well. At a certain point in this vertical well, a turn of the drilling tool is initiated which eventually brings the drilling tool into a horizontal position thereby allowing the drilling of a horizontal or lateral well. In the past, horizontal/lateral wells have generally been used for draining large areas or as collector radials for large diameter wells.

When oil and gas recovery became more important, horizontal wells were used to access irregular fossil energy deposits in order to enhance such recovery. Furthermore, horizontal drilling techniques have also been used for placing underground conduit systems beneath obstacles such as lakes, rivers, and other at and below-ground-level obstructions.

Even more recently, horizontal wells and the lateral drilling technology used to form the same have been applied in the field of pollution control. More particularly, horizontal wells can be placed beneath landfills, hazardous waste sites, or potentially or actually leaking underground storage tanks in order to monitor the migration of a hazardous substance and to prevent the hazardous substance from reaching the ground water. Horizontal wells can also be used for remediation purposes.

For example, U.S. Pat. No. 4,832,122 to Cory, et al., discloses an in-situ remediation system for contaminated ground water which discloses the use of two horizontal wells, one positioned below the plume in the saturated zone and one above the plume in the vadose zone. A fluid is injected through the lower horizontal well into the saturated zone and, after reacting with the contaminant, is removed by the upper level extracting well for further treatment. See also, "Radial Wells and Hazardous Waste Sites", W. Dickinson, et al., RCRA SITE REMEDIATION, pp. 232–237.

Unfortunately, the prior art horizontal drilling technology has not been fully successful, especially for use with the remediation and monitoring of hazardous substances. Even though lateral drilling technology for drilling short, medium, and long-radius lateral bore holes is available (see, e.g., "Lateral Drilling Technology Tested On UCG Project", P. B. Tracy, IADC/SPE Paper No. 17237, pp 493–502 (1988)), new and special techniques are needed to overcome the problematic application of lateral drilling technology to environmental problems.

More particularly, horizontal drilling systems for use with environmentally sensitive applications need to be extremely accurate, both in initial drilling accuracy and later monitoring accuracy, they need to be portable, maneuverable, and fast, and they need to drill and form a horizontal well which will maintain its integrity in a variety of corrosive and damaging environments. Furthermore, horizontal drilling systems must be cost-effective in order to meet the requirements of today's cost conscious communities and their governments.

SUMMARY OF THE INVENTION

The present invention provides a safer, more efficient, and lower cost horizontal well drilling system, particularly for use in environmental applications, and provides a system for placing horizontal wells into a variety of areas, even areas which cannot be sampled or remediated with vertical wells. Moreover, the invention provides a system for placing a horizontal well which is drilled, cased, and screened, if desired, simultaneously in order to maintain hole integrity, speed up operations, and isolate problem zones, and for subsequently filter packing a horizontal well in order to keep sand and other objects from entering the well and/or to prevent clays or other objects from clogging the screen. The present invention also provides a horizontal well drilling system which assures quickness and accuracy under demanding and environmentally stressful conditions.

In general, the system of the present invention as disclosed herein uses a slant drilling rig, a steerable drilling system equipped with a downhole hydraulic motor and a filter packing system which assures effective well development. The system further uses a dual drill string including a minimally reactive well casing and liner and an inner drill pipe that first pulls the casing and then the liner into place as the drilling proceeds. The drilling rig circulating system is a closed loop system which is self-contained and does not permit cuttings or drilling water to be spilled into the environment.

The horizontal drilling system disclosed herein performs generally as follows. The slant drilling rig is rigged and a conductor casing is set. This conductor is cemented or grouted into place. The curved portion of the well is drilled and cased, and this casing is cemented into place. The horizontal section of the well is then drilled and lined, with the liner being slotted or perforated in areas where it will act as a screen. Thereafter, the liner can be filter packed and pumping equipment installed.

DETAILED DESCRIPTION OF THE INVENTION

Before any drilling begins, the horizontal/lateral well placement is carefully engineered to meet monitoring or remediation objectives for the most efficient contaminant particle capture. The depth and direction of the horizontal well bore, screen length, development, and pumping methods are determined.

Figure 1:
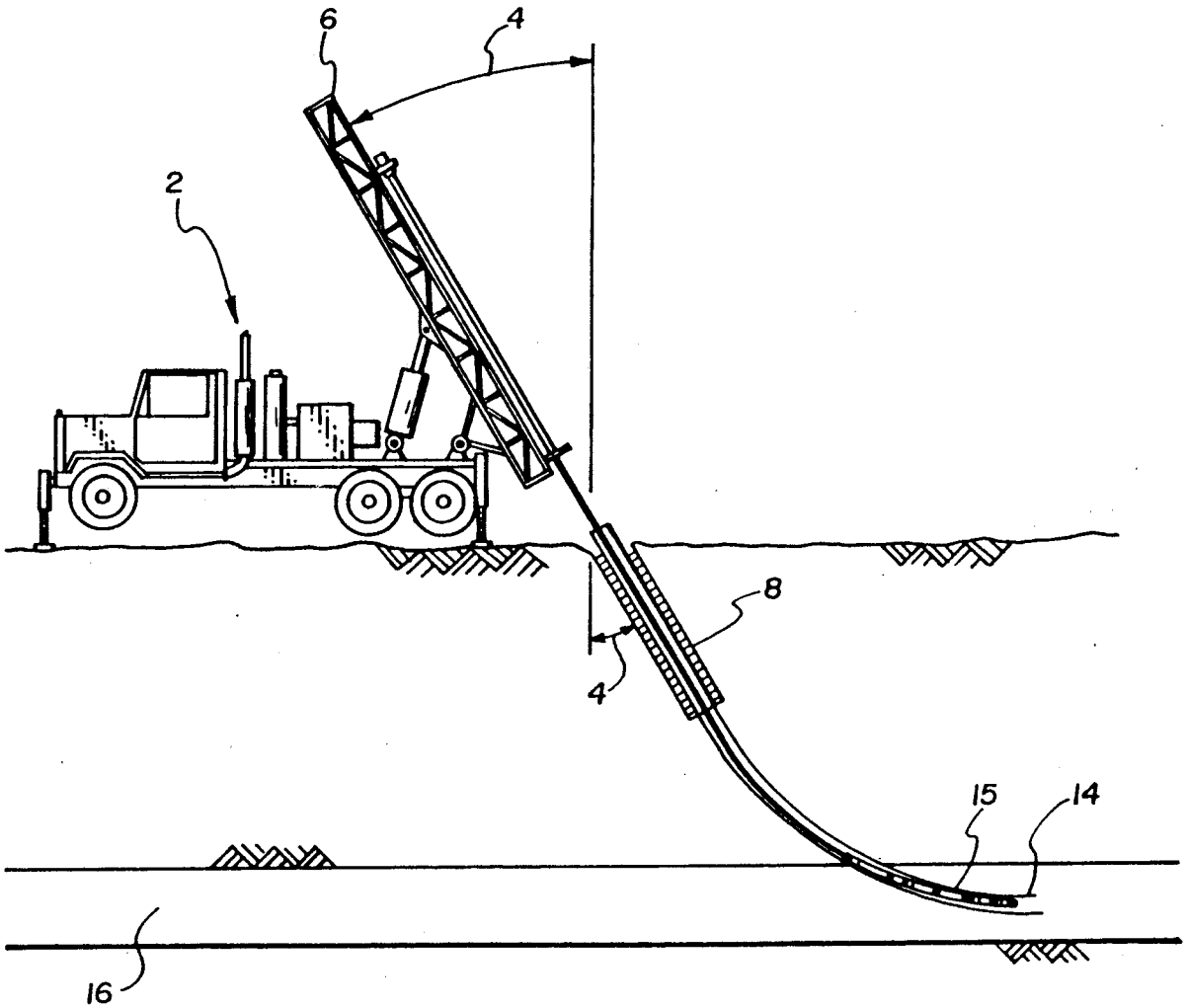
FIG. 1 is a schematic diagram of a slant rig and one initial drilling configuration for use with the horizontal well drilling system as disclosed by this invention.

With reference now to FIG. 1, the rig 2 may be moved onto the well site and aligned in such a way that the horizontal/lateral well 14 is drilled in the desired direction. The angle 4, from vertical, of the rig's mast 6 is adjusted so as to drill the lateral well 14 at the proper depth or within the target zone 16. An initial hole is then augered into the soil and a conductor pipe 8 is set and cemented or grouted into place.

Figure 2:
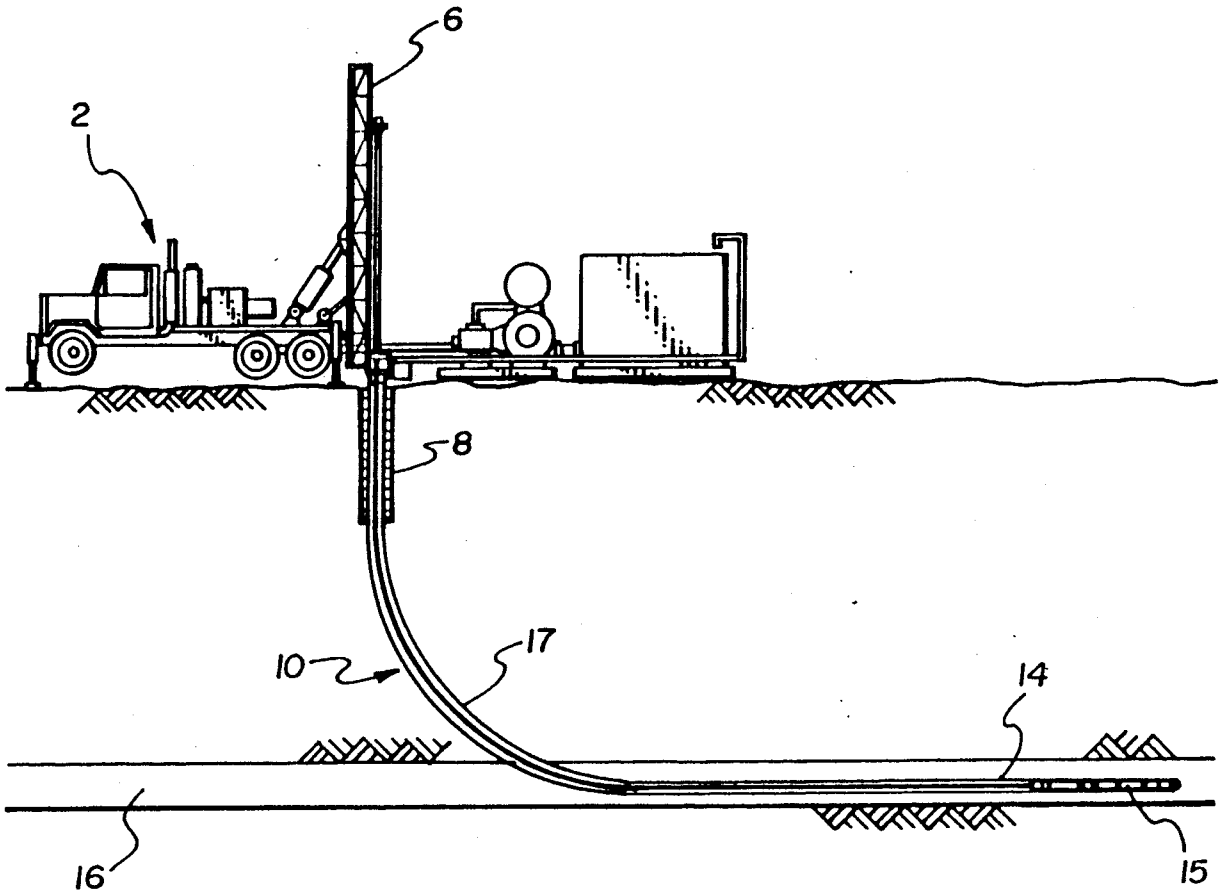
FIG. 2 is a schematic diagram of the slant rig in a vertical position with the horizontal well drilled.

With reference now to FIG. 2, when the rig mast 6 is oriented in a completely vertical position, as is the case when a horizontal well is to be placed at a deeper location, the curved section 10 of the well bore is started at a depth that allows the curve to reach a horizontal position at the desired location and within the target zone 16. The curved section 10 is drilled and cased at the same time, preferably with a minimally reactive casing, e.g., high-density polyethylene (HDPE), teflon, polypropylene, stainless steel, carbon steel, fiberglass, PVC, etc. After the curve reaches a more or less horizontal position, the casing is cemented into place thereby sealing and isolating the curved section 10 and preventing cross-contamination of the formations contacting the curved well bore.

Figure 3:
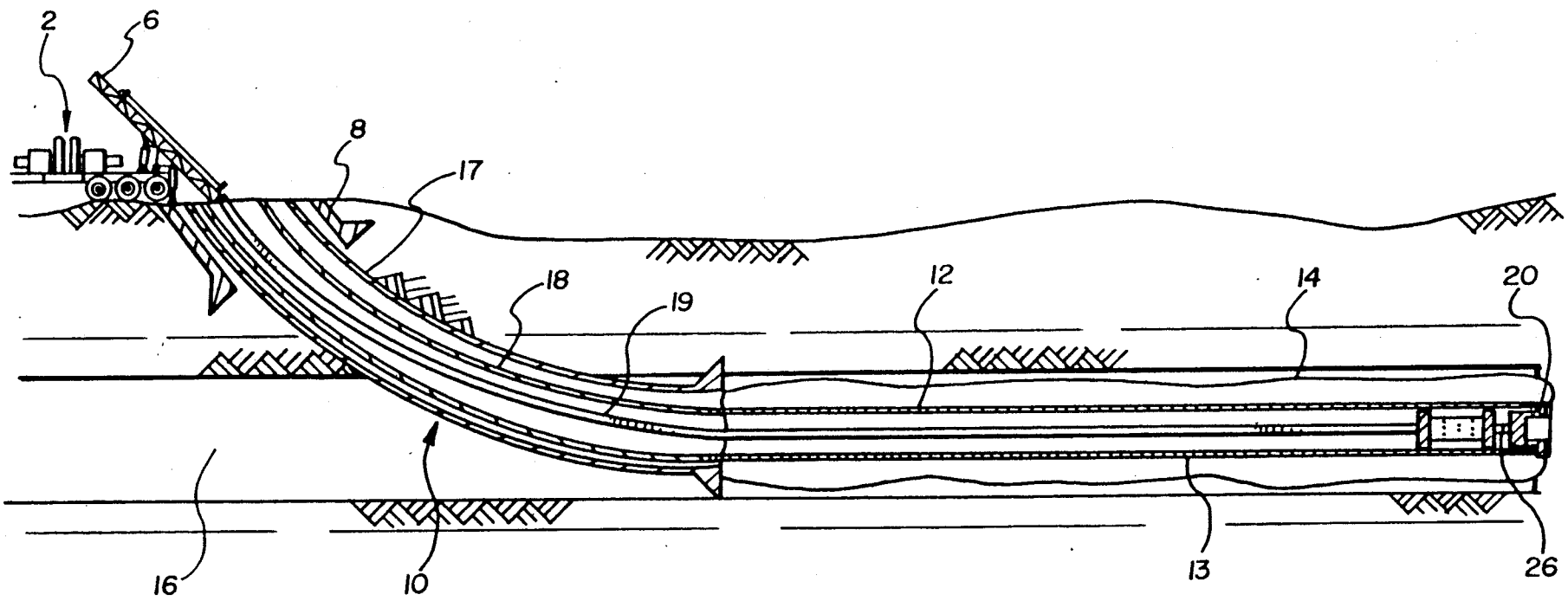
FIG. 3 is a schematic diagram indicating the setting of the plug at the end of the lateral well hole.

FIG. 3 shows, on a large scale, the detailed construction of the curved section 10 which includes the curve casing 17, the lateral liner 18, and a drill pipe 19. The lateral liner 18 is also preferably made of minimally reactive material such as HDPE, teflon, polypropylene, stainless steel, carbon steel, fiberglass, PVC, etc.

The steerable drilling capability for forming the curved section 10 can be provided by any generally steerable drilling motor known in the art. See, e.g., U.S. Pat. Nos. 4,333,539 and 4,739,842.

The horizontal well section can also be extended by a variety of apparatuses and methods. See, e.g., U.S. Pat. Nos. 4,333,539 and 4,842,081.

A preferred steerable system for forming both the curved and the horizontal well portions includes concentric stabilizers on a casing and the liner, both surrounding a water based drill fluid powered hydraulic motor with eccentric stabilizers thereon to tilt the motor at a slight angle to the surrounding casing or liner. The eccentrically mounted motor can be rotationally reoriented within the concentrically stabilized casing or liner to thereby change the motor's drilling direction and thus the direction of the well bore.

This steerable drilling apparatus and method for using the same are described more fully and claimed in a copending United States Patent Application identified as Ser. No. 07/541,836 and filed on even date herewith and incorporated herein for all purposes by this reference. Of course, other motors such as a suitable oil based fluid hydraulic motor, electric motor, or an air motor could also be used.

Furthermore, a conventional survey instrumentation system can be used to measure the tool face orientation, azimuth and angle of inclination of a well bore drilled by the horizontal well drilling system disclosed herein. A preferred articulated instrument assembly for use with the present system is disclosed in U.S. Pat. No. 4,901,804.

Additionally, many suitable bit designs can be used with the present horizontal well drilling system. Some such suitable bit designs are disclosed and claimed in a copending U.S. patent application identified as Ser. No. 07/541,841 filed on even date herewith and incorporated herein for all purposes by this reference.

As the horizontal well portion is drilled, the screen 12 which is part of the lateral liner 18 and forms a continuous pipe therewith is pulled into the lateral well bore by the drilling assembly 15. The screen 12 is formed by a plurality or perforations, generally indicated by the number 13 in the liner 18. The perforations 13 can be made in varying shapes and sizes in order to enhance the screening action and also to allow for adequate flow therethrough. For example, the perforations 13 can be slits, slots, or holes. The perforations 13 can also be variously spaced throughout the liner 18 forming permeable and non-permeable sections of the liner 18 depending on the specific requirements of each application. The casing 17, liner 18, and screen 12 all include centralizers (not shown) to center the same within the bore hole and to facilitate even cementing, filter packing, and annular flow.

Furthermore, the drilling assembly 15 can include a coring tool (not shown) which can be used to cut a sample from the well bore whenever one is required. One suitable coring tool is disclosed and claimed in a copending U.S. patent application identified as Ser. No. 07/541,836 and filed on even date herewith and incorporated for all purposes herein by this reference.

Figure 4:
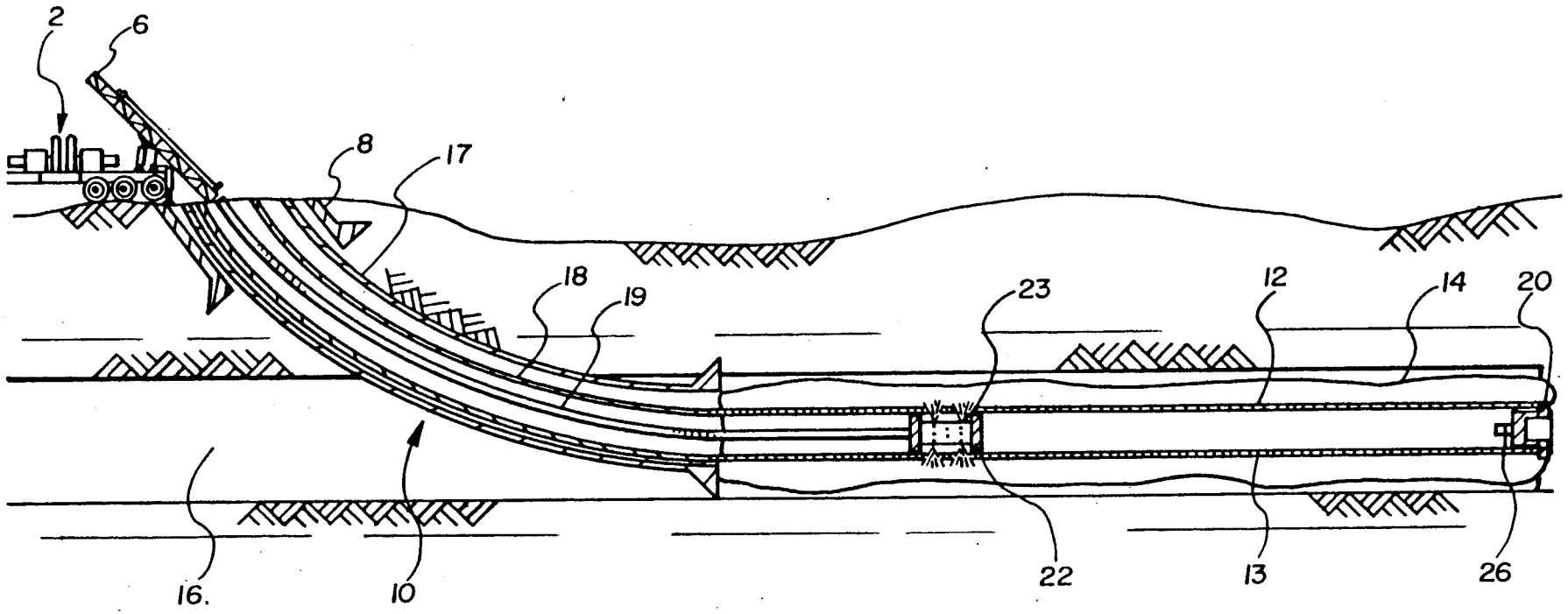
FIG. 4 is a schematic diagram indicating the washing of the screen with a jet wash sub.

Once the desired horizontal length of the lateral well bore is reached, the well itself is ready for development. First, the drill string is removed from the well leaving the screen 12 in place. With reference again to FIG. 3, a plug 20 is placed at the end of the screen 12 which is itself at the lower end of the horizontal well bore 14. The plug 20 is driven in with the drill pipe 19 and lodged at the end of the screen 12 thereby effectively sealing the end of the horizontal well bore 14. As shown in FIG. 4, the screen 12 is then washed with a wash sub 22 in order to remove any drill cuttings plugging the screen slots or remaining in the well bore 14. The wash sub 22 contains oriented nozzles 23 which spray jets of water outwardly, thereby clearing any blockage in the screen perforations.

Figure 5:
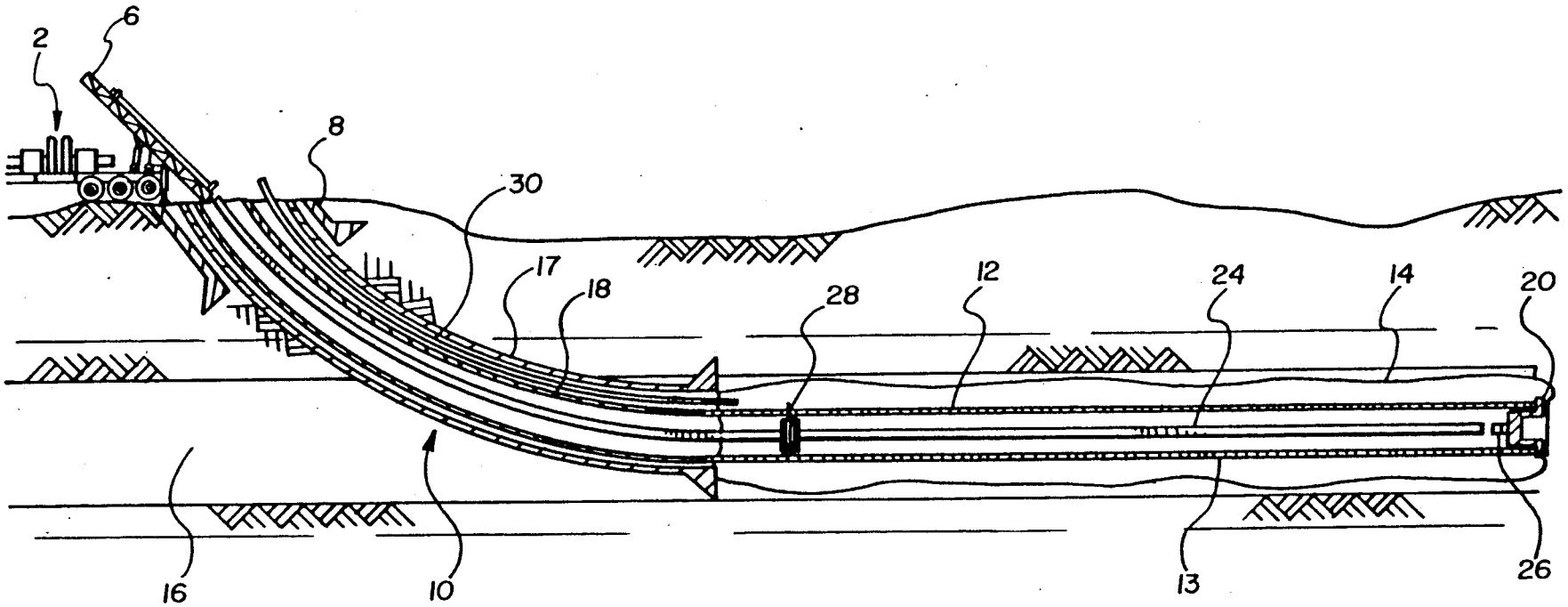
FIG. 5 is a schematic diagram of the fluid return line reaching to the end of the horizontal well and of a tremi tube within the curved annulus.

The well bore 14 can then be filter packed if a filter in the annular volume between the well bore 14 and the screen 12 is desired. The wash sub 22 is pulled out of the hole and laid down. With reference now to FIG. 5, the filter pack fluid return line 24 is run into the hole within the liner 18 and screen 12. The fluid return line should be tallied in order to insure that the end of the line 24 is run into the shoe joint 26. The shoe or latch joint 26 is part of the plug 20 mechanism placed at the end of the screen 12.

The filter pack fluid return line 24 can include an annular flow restrictor 28. The position of the flow restrictor 28 on the filter pack fluid return line 24 is initially generally such that the restrictor 28 is inside the slotted area of the screen 12 when the filter pack fluid return line 24 is in place. The fluid flow restrictor 28 serves to block a section of the screen 12. Preferably, the fluid return line 24 is made of plastic of equal or near equal density to that of the fluid in the hole in order to allow the fluid return line 24 to be nearly neutrally buoyant in the well bore thereby not damaging the inner surface of the liner 18 or the screen 12 by banging, grating, etc. against it or forcing the liner 18 or screen 12 off-center by pushing against it and thereby its centralizers.

A filter pack tremi tube 30 can be run into the casing annulus between the curve casing 17 and the lateral liner 18, also as shown in FIG. 5. The tremi tube 30 may not be necessary if the filter pack fluid and media can be displaced down the casing annulus itself. The casing annulus is then sealed and a pressure gage (not shown) is installed to monitor the same. The pressure within the casing annulus needs to be monitored so that excessive pressure does not, for example, fracture the formation or blow out a shallow well in a soft formation. Furthermore, excessive pressures within the casing annulus may break down the casing cement or the formation surrounding it thereby allowing unwanted contamination of the curved bore hole 10.

The top down filter packing operation can now proceed. The top down filter packing procedure is started by establishing reverse circulation into the lateral hole through the casing annulus and back to the surface through the fluid return line 24. A pump (not shown) can be rigged up to pull a vacuum on the fluid return line 24. This will reduce the hydrostatic head and assist reverse circulation. An air injection line (not shown) may also be inserted into the fluid return line 24 for injecting air into the returning fluid. The air injection line could be inserted as far down as to the point where the well bore is almost horizontal, depending on how much head reduction is necessary. Air injected into the fluid return line 24 would reduce the hydrostatic head of the fluid column thereby assisting reverse circulation.

The use of a suction pump or air injection line to reduce the hydrostatic head will depend on the hole depth and the amount of hydrostatic head to be reduced in order to allow for more uniform and less pump pressure assisted filter packing. Such "suction" packing would help prevent fracturing of the formation due to excessive pumping pressure.

Figure 6:
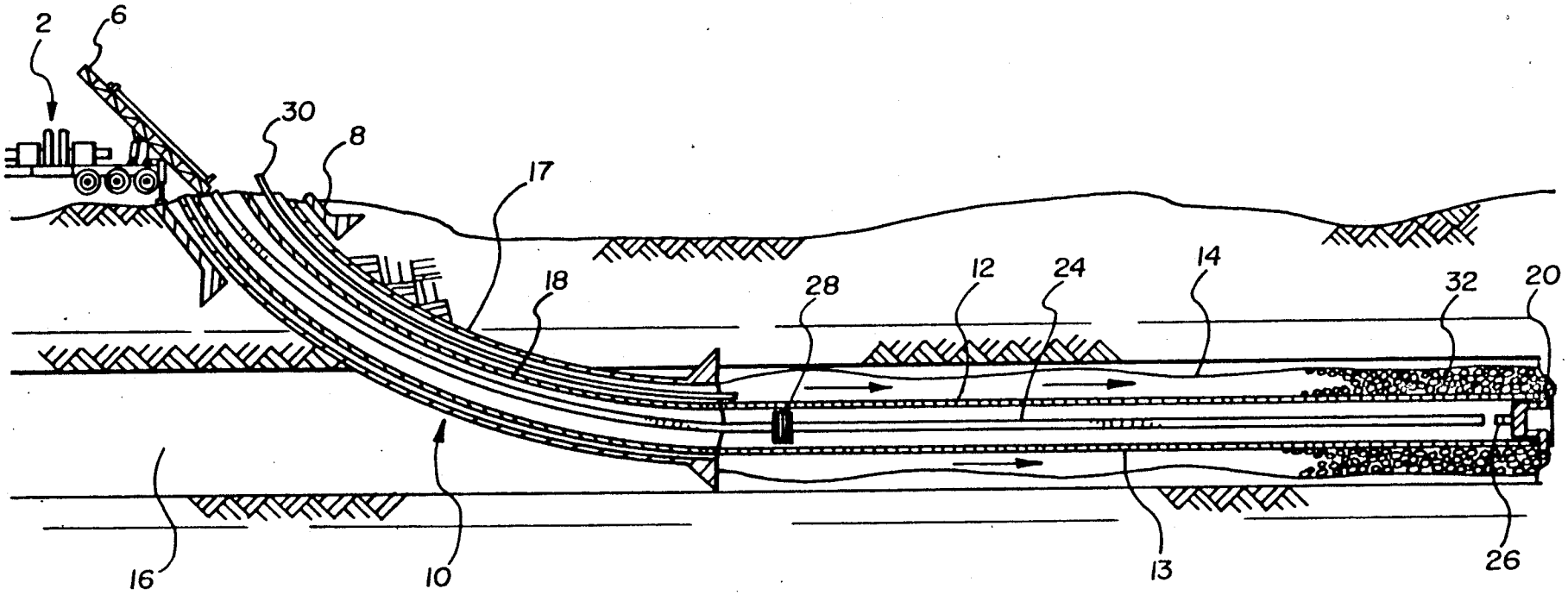
FIG. 6 is a schematic diagram indicating the gravel packing of the lateral well from the end of the well towards the flow restrictor.

With reference now to FIG. 6, the filter pack media 32 is added to the circulating fluid. With water as the circulating fluid, the filter pack media should preferably be a low density material such as HDPE, polypropylene, LDPE, pumice, hollow glass beads, etc. In any case, the filter pack media should preferably be of a matched density equal to or nearly equal to that of the circulating fluid so that the media does not tend to collect at either the upper or lower level of the lateral hole. During the filter packing, the casing annulus and pump pressure gages (not shown) need to be monitored closely. An increase in the annular pressure or pump pressure would indicate that the filter pack media 32 has filled/plugged the annular volume between the screen 12 and the well bore 14 from the closed end of the well screen 12 to the location of the flow restrictor 28. This pressure increase is seen because the circulating fluid is forced through the filter pack material 32 which has a higher resistance to flow than the screen 12.

Figure 7:
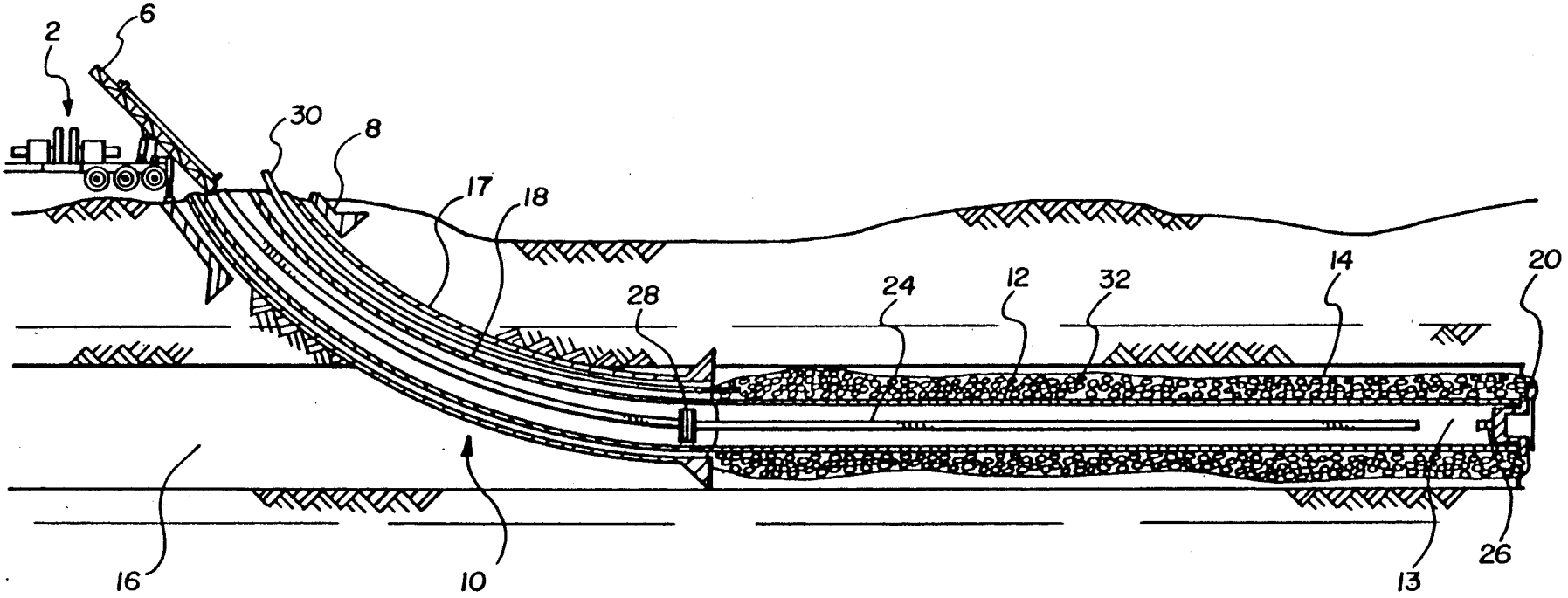
FIG. 7 is a schematic diagram indicating the removal of the fluid return line uphole and the completion of the filter packing step.

Once that occurs, the fluid return line 24 should be pulled so that the flow restrictor 28 is pulled back up inside the solid casing 17, as shown in FIG. 7. This last section of the screen 12, whose length is generally equal to that of the flow restrictor 28 and thereby known to the operator, can then be finish gravel packed with a higher density material such as PVC, CPVC, gravel, barium sulfate, sand, or other material, as needed. In any case, this capping material should have a density higher than that of the filter pack media already in the hole and thereby that of the circulating fluid. The use of a higher density material would form a cap over the lower density filter pack media and keep the lower density material in place. The filter packing procedure can be stopped when the filter pack media has been placed up to the open end of the screen 12 or even further up towards the surface. Of course, a large variety of different filter pack media with differing densities can be used in a variety of combinations depending on the specific needs of each application.

Alternatively, the well could also be filter packed completely to the upper end of the slotted screen 12 and then held in place by the circulation of a sealing element such as bentonite pellets that would expand with time to hold the filter pack in place and effectively seal the space between the liner 18 and the casing 17.

The filter packing equipment can then be rigged down, pulled and the fluid return line 24 laid down. Any additional tremi work that is needed, such as the sealing and supporting of the casing annulus with bentonite pellets, can be performed after which the tremi tube 30 can be pulled and disconnected. Additional development work can be performed at this time. For example, an electric submersible pump can be lowered into the well to complete the well development. Once the development is completed, any extra equipment needed for the ground water monitoring or remediation or for the draining of the problem site can be put into place.

In the foregoing specification, this invention has been described with reference to a specific exemplary embodiment thereof. It will, however, be evident that various modifications and changes may be made thereon without departing from the broader spirit and scope of the invention as set forth in the appended claims. The specification and drawings included here are, accordingly, to be regarded in an illustrative rather than in a restrictive sense.

What is claimed is:

1. A method of preparing a lateral well bore comprising the steps of:

drilling a well bore until said well bore is substantially in a horizontal position;

continuing drilling in a substantially horizontal direction and simultaneously placing a liner including a screen means along the lateral well bore formed thereby to define an annular volume between the wall of said lateral well bore and the exterior of said liner;

reacting the desired horizontal length of said lateral well bore;

sealing the lower end of said lateral well bore;

washing said screen means;

running a filter pack fluid return line into said liner;

establishing fluid circulation from the surface into the annular volume between the liner and the lateral well bore wall, through said screen means and back out through said fluid return line;

adding filter pack media to said circulating fluid; and substantially filling the annular volume between said liner and said lateral well bore from the lower end of said lateral well bore with the filter pack media.

2. A method according to claim 1 wherein a gravel pack tremi tube is run into said annular volume to deliver said circulating fluid thereto.

3. A method according to claim 1 wherein the step of substantially filling the annular volume with the filter pack media further includes substantially restricting the fluid flow through a section of said liner and the screen means therein so that a pressure rise in said annulus indicates that the filter pack media has filled said annular volume up to the location of said fluid flow restriction.

4. A method according to claim 1 further including the lowering of the hydrostatic head in said fluid return line during at least a portion of the step of substantially filling the annular volume with the filter pack media.

5. A method according to claim 1 wherein said filter pack media is of a density matched to that of the circulating fluid.

6. A method according to claim 1 wherein said filter pack media within said lateral well bore includes a section of filter pack media with a density matched to that of the circulating fluid and a section of higher density filter pack media.

7. A method according to claim 1 further including the step of circulating a sealing element to hold said filter pack media in place.

8. A method according to claim 5 wherein said filter pack media is comprised of high density polyethylene, polypropylene, low density polyethylene, pumice, or hollow glass beads.

9. A method according to claim 6 wherein said filter pack media is comprised of high density polyethylene, polypropylene, low density polyethylene, pumice, or hollow glass beads.

10. A method according to claim 6 wherein said higher density filter pack media is comprised of polyvinyl chloride, CPVC, barium sulfate, gravel, or sand.

11. A method according to claim 7 wherein said sealing element is comprised of bentonite pellets.

12. A method according to claim 1 wherein said liner is comprised of high density polyethylene, teflon, polypropylene, stainless steel, carbon steel, fiberglass, or polyvinyl chloride.

13. A method according to claim 1 wherein said horizontal drilling step includes the step of taking an uncontaminated core sample from said lateral well bore.

14. A method according to claim 1 wherein said screen means is formed by a plurality of perforations in said liner.

* * * * *

UNITED STATES PATENT AND TRADEMARK OFFICE

CERTIFICATE OF CORRECTION

PATENT NO. : 5,040,601

DATED : August 20, 1991

INVENTOR(S) : Haraldur Karlsson, et.al.

It is certified that error appears in the above-identified patent and that said Letters Patent is hereby corrected as shown below:

In column 6, line 45, "reacting" should read --reaching--.

Signed and Sealed this

Twenty-second Day of December, 1992

*Attest:*

DOUGLAS B. COMER

*Attesting Officer*

*Acting Commissioner of Patents and Trademarks*